United States Patent [19]

·Plaschka et al.

[11] Patent Number: 4,508,244

[45] Date of Patent: Apr. 2, 1985

[54] PRESSURE CAN FOR APPLICATION OF MOUNTING FOAMS, IN PARTICULAR, SINGLE-COMPONENT POLYURETHANE FOAMS

[75] Inventors: Emil Plaschka, Marbella, Spain; Mathias Pauls, Haltern, Fed. Rep. of Germany; Guido Niggli, Balgach, Switzerland

[73] Assignee: Polypag A.G., Switzerland

[21] Appl. No.: 439,418

[22] Filed: Nov. 5, 1982

[30] Foreign Application Priority Data

Nov. 6, 1981 [DE] Fed. Rep. of Germany ..... 3144094
Nov. 27, 1981 [DE] Fed. Rep. of Germany ..... 3147004
Nov. 27, 1981 [DE] Fed. Rep. of Germany ..... 3147006

[51] Int. Cl.[3] ..... B65D 83/14

[52] U.S. Cl. ..... 222/153; 222/182; 222/387

[58] Field of Search ..... 222/130, 153, 182, 386, 222/387, 389, 394, 402.1, 402.12, 402.13, 402.16, 402.22, 405, 542

[56] References Cited

U.S. PATENT DOCUMENTS 2,737,416 3/1956 Behr et al. ..... 222/402.13
2,809,774 10/1957 Kaye et al. ..... 222/263
2,980,299 4/1961 Smith ..... 222/182
3,262,607 7/1966 Hirsch ..... 222/182
3,273,762 9/1966 O'Niell, Jr. ..... 222/389
3,760,987 9/1973 Meterhoefer ..... 222/153
4,253,459 3/1981 Willis ..... 222/567 X

*Primary Examiner*—Joseph J. Rolla
*Assistant Examiner*—Michael S. Huppert
*Attorney, Agent, or Firm*—Price, Heneveld, Huizenga & Cooper

[57] ABSTRACT

A pressure can for dispensing polyurethane foams including a cylinder and a dome-like upper part with an opening therethrough. A closure member closes the opening and seals it and a valve body is inset in the closure member for dispensing the contents of the can. A can bottom covers the end of the cylinder opposite from the upper part and a piston is slidably disposed in the cylinder intermediate its ends for dividing the cylinder into a foam-former filling space between the piston and closure member and propellant space between the piston and the can bottom. The piston has a cylindrical depending skirt providing a gap between it and the cylinder wall sufficient to permit a limited amount of propellant to pass into the foam-former filling space but too restricted to permit the foam-former from passing from the foam-former space to the propellant space. The propellant dissolved in the foam former will flash when the filling is dispensed from the can at atmospheric pressure, creating bubbles to enhance foaming. A gas-tight cap prevents diffusion of water vapor into the can during storage.

14 Claims, 3 Drawing Figures

Figure 1:
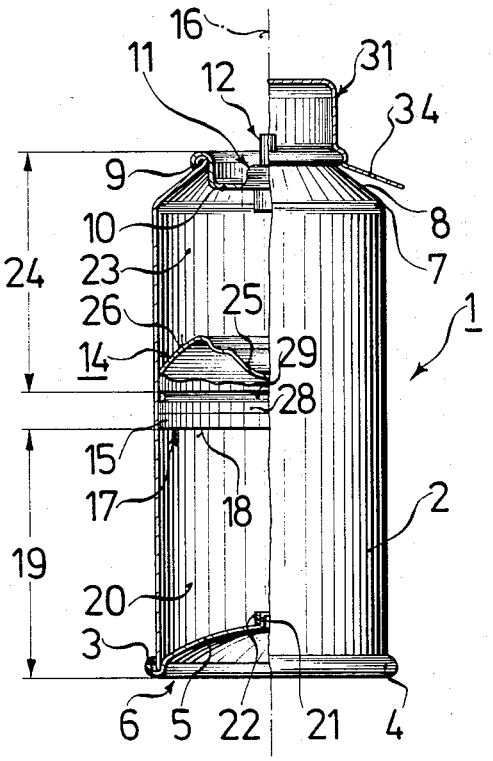

PRESSURE CAN FOR APPLICATION OF MOUNTING FOAMS, IN PARTICULAR, SINGLE-COMPONENT POLYURETHANE FOAMS

The invention relates to a pressure can for the application of mounting foams, in particular, of single-component polyurethane foam, the can body of which has a cylinder, a preferably indented bottom, and a dome-like upper part with a closure in which is inset a valve for release of the can filling consisting of a pressurizing agent and a foam forming medium.

Such pressure cans are in general filled with various materials, including sealing materials of rubber-oil, butyl, silicone, or acrylate base or other base materials. The preferred field of application of the invention is that of polyurethane foams, which are used for sealing, caulking, insulating, adhesion and fastening, in particular in building. In general steel cans are used for these materials because of the considerable internal pressure with special valves which facilitate the processing of the can contents.

Pressure cans of this kind are known (DE-GM No. 77 10 802.2) [German Utility Model]. A filling is supplied within such cans that in the preferred field of application of the invention consists of the various formulation components of the polyurethane prepolymer (about 60%) and of the propellant gas (about 40%). Part of the propellant gas, making up about 10 percent of the total filling, is required as so-called "yeast" for the formation of foam. The rest of the propellant gas serves as transport means. When the can is stored for a long time, it is found that the components of the formulation separate from each other. Because of this, intensive mixing must be carried out before use by vigorous and lengthy shaking. The gas acting as propellant evaporates after emergence of the foam. The yield of foam is influenced by various factors. According to the kind of foam, however, the foam yield amounts to 25 to a maximum of 30 liters for a 1 kg pressure can. Hitherto it has not been possible to substantially increase the foam yield. It is found, in fact, that about 5% of the polyurethane prepolymer remains unused in the can after this has been fully emptied of its propellant gas.

Pressure cans are known for various purposes, among them for spraying insecticidal and fungicidal liquids (GB-PS No. 746,895), in which on the one hand the contact of the propellant gas with the liquid to be dispensed, and on the other hand exit of the propellant gas into the atmosphere, are prevented by a flexible membrane which forms a partition between a container part exclusively containing propellant gas and a further part receiving the liquid to be applied. When the container valve is opened, the membrane is pushed in under the pressure of the propellant gas into the liquid section and thus compresses the liquid, which is consequently driven out of the container without the propellant gas. However, this method requires an expensive overall construction of the pressure container, and this is not tolerable for usual materials of the kind mentioned at the beginning. Apart from this, there are then difficulties in connection of the propellant gas portion needed for the "yeast".

The object of the invention is to design cans of the general structure described at the beginning with low cost and such that the passage of the propellant gases into the atmosphere is restricted or completely prevented and the method of use is simplified.

According to the invention, this problem is solved in that the skirt of a floating piston is guided on the internal wall of the cylinder of the can body, the piston being arranged floating between the propellant and foam forming material provided in separate can spaces, and separates the propellant gas space, enclosed by the can bottom and by a variable lower length of the cylinder wall, from the space receiving the foam forming components and enclosed lying above it, by the piston floor and the remaining length of the cylinder and the closure.

According to the invention, the foam forming components, i.e., for example, the polyurethane prepolymer, is driven from the initially larger space of the pressure can due to the propellant pressure existing on the can bottom as soon as the valve is opened from which the foam emerges. The piston then travels upward along the cylinder wall. Propellant can then overflow between the piston skirt and the cylinder wall into the foam forming components. In these it forms at least a part of the required "yeast". Another part can be introduced into the foam forming components when the pressure can is filled. On the other hand, mixing of the foam forming components with the propellant is prevented by the piston. Shaking of the can before use is thus no longer necessary. The amount emerging is also no longer impaired by the propellant. Propellant can only emerge to a small extent and only when the piston has reached its upper end position. However, in this position of the piston a complete emptying of the foam forming components has already occurred.

The invention thus has the advantage that the overflow of the portion of the propellant gas acting as transport means into the atmosphere is largely prevented, and on the other hand that the foam yield can be considerably increased. In comparable cases it is 50–60 l, the respective amount depending on the kind of foam. The invention has the further advantage that the new can can be processed in any position. Thus it does not have to be held perpendicularly during operation with the valve downward. This is particularly favorable in ceiling areas and at difficultly accessible places in building, e.g., for foaming out of floors.

The invention also permits the use of the piston for complete emptying of the foam forming components. For this purpose it is in particular specified according to the invention to provide the floor of the piston with an indented center and frustroconical edge surfaces and to apply it from inside against the dome-like inner part and also the closure.

The foam forming components are filled from above into the still empty pressure can, which however has already been provided with the piston; liquid propellant is introduced from the other side. An embodiment of the invention is recommended for this which has a flanged-on floor at the lower edge of the cylinder and having a propellant filling opening with a one-way valve. A particularly simple embodiment of such a one-way valve is characterized by a plug of an elastomeric material pressed into the floor and penetrable by a filling needle. When the filling needle is withdrawn, the filling needle opening closes of itself.

In prior art pressure cans, the valve body is designed such that the respective amount of foam can be metered out with the valve and even deep, narrow and covered cavities can be filled directly from the pressure can. This makes necessary a special type of construction of the valve body, which must be sealed against the plate with a rubber seal. The tubular valve body can tilt in this rubber body, so that the seal can be lifted and the foam can emerge through the tubular, projecting-out part of the valve body.

To prevent the outward-projecting part of the valve body from being inadvertently tilted during transport and storage of the can, the can body must carry a cap, usually of plastics. In general, that is, such pressure cans are stored by the producer, dealers, and user for a time which cannot be precisely determined in advance. Certain foam forming components, particularly isocyanate, tend to stick on entry of atmospheric moisture. It is found that the rubber seal allows atmospheric moisture to diffuse in from outside through the valve body after a certain storage time, so that in use the can contents can no longer be used. In storage and/or transportation, it happens that the cap loosens and the outward-projecting part of the valve body is bumped. The foam then emerging gums up the valve and makes the can contents unusable.

In order to prevent at least the diffusion of moisture in, it is known to provide on the inner side of the can bottom a drying agent which takes up the atmospheric moisture that has penetrated under the cap. However, experience shows that the kind and amount of drying agent is insufficient to prevent losses due to diffused-in moisture during average storage times. Apart from this, such caps can as little prevent emergence of foam due to the seal becoming unsealed in the valve body as that due to the inadvertent or improper actuation of the valve.

According to an advantageous kind of embodiment of the invention, gas exchange of the cap space with the atmosphere is prevented until the use of the can contents, and the valve body is made inaccessible when the cap is intact. It is provided for this purpose that the cap has a rim lying gas-tightly around the closure edge, with its inner edge holding an annular seal on the plate edge and which has an edge axially locking the cap and separable by means of a handle fitted on the cap.

A double seal against diffused-in atmospheric moisture is thus created, since the air enclosed by the cap and its rim is shut off by the valve seal from the can contents, while the rim seal shuts off the enclosed air from the atmosphere. Hence the amount of atmospheric moisture which can diffuse in is so strongly reduced that the closure is secured against locking and sticking. Apart from this, the cap can be removed only by destroying its rim. This cannot occur inadvertently. Consequently, improper use can be detected from a damaged rim.

The invention has the advantage that it uses the constructional parts already present in the valve closure for fitting and sealing the cap. The plate edge can be used as a seat for the annular seal by crimping the cap rim. There then results a great simplification and also a reduction of the size of the cap, since its diameter can be reduced practically to the diameter of the plate floor. This simplication and saving of material permits the invention to be put into practice without appreciable additional cost, in spite of the quantity of such pressure cans which have to be placed on the market.

In a further embodiment of the invention, the cap has a cylindrical connecting part between the inner plate edge and the edge which axially locks it. Since the cap edge effecting axial locking is first flanged inward on crimping the cap and previously forms a part of the cylindrical section of the rim, the cap can as a result be simplified.

Figure 2:
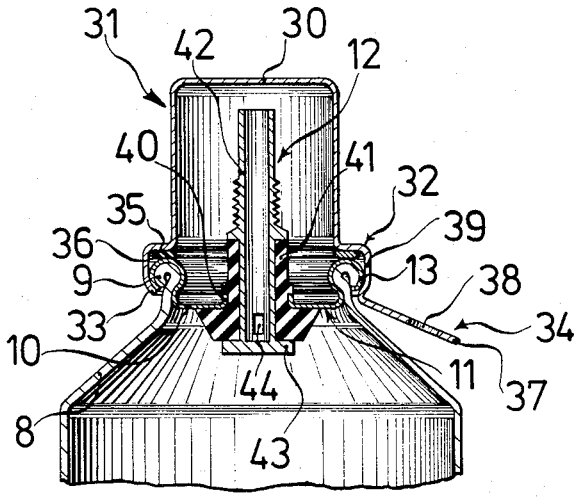

Details of the invention are shown by the following description of an embodiment with reference to the figures in the drawing, in which are shown:

FIG. 1 schematically, and omitting all details not necessary for understanding the invention, a pressure can according to the invention, partially in section;

FIG. 2 enlarged, the upper end of the pressure can, in section; and

Figure 3:
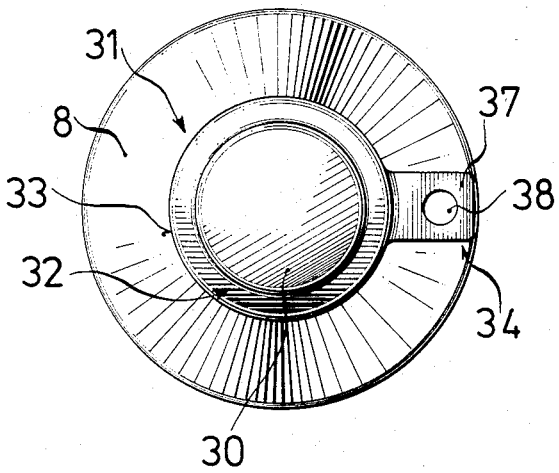

FIG. 3 a plan view of the object of FIG. 2.

The pressure can shown has a body generally denoted by 1 and consisting of steel sheet in the embodiment shown. The middle part consists of a cylinder 2, the lower end edge of which is flanged together at 3 with the edge 4 of a bottom 6 indented at 5. The upper edge 7 of the cylinder 2 merges into a dome-like, i.e., frustroconical upper part 8, the edge 9 of which surrounding an opening shows a closure generally denoted 11. This closure has a plate 10, the edge 13 of which is crimped about the edge 9. The plate 10 has a middle opening 40, in which is fitted a plug-like rubber seal 41 of a valve generally denoted 12. The valve body 42 is tubular and is closed at its inner end 43 with a plate that lies, under the influence of the internal pressure, against the rubber seal. Below the plate and within the externally sealed tube part are one or more openings 44, through which the can contents can emerge as soon as the valve body 42 is tilted and the valve plate 43 is thus lifted.

A piston, generally referenced 14, is floatingly arranged in the cylinder 2. The piston skirt 15 is guided on the cylinder wall, but the piston has enough play in the can to be movable without jamming in the direction of the can axis 16.

The bottom of the piston 17 closes, with its underside 18, a varied lower length 19 of the cylinder 2. The section 19 of the cylinder 2 surrounds a space 20 which is filled with propellant and closed off from the exterior by the can bottom 6. The filling of the propellant is effected by means of a filling needle (not shown) via a radial opening 21 of a valve shoulder in the can floor and a rubber valve ring 22 which is laid around the valve shoulder.

The piston floats on the filling of the propellant gas space 20 and on the liquid foam forming component which are located in the space 23 above the piston floor 17. This space is enclosed by the remaining length 24 of the cylinder 2, the dome 8 and the closure 11.

According to the embodiment shown, the piston floor is provided, on its side facing the space 23, with an indented center 25 and has generally frustroconical edge surfaces 26, which are, however, curved outward, i.e. convex, in the embodiment shown. Parts of the surfaces 25, 26 can abut from inside on the dome-like uppper part or on the closure, as soon as the piston 14 has reached its end postion.

The foam forming constituents are introduced into the can, which is initially open at the top; a certain amount of propellant gas is added to the foam forming components and later forms a part of the yeast. After the folding the edge of the plate around the edge 9, the can is closed. The valve insert forms the inner seal to be overcome by the user according to need when the can concontents are used. However, such a seal can also become non-sealing for various reasons, in particular, during a long storage time, to diffused-in moisture. This would lead to reactions with the foam forming constituents in the region of the valve insert 12 and hence to sticking and finally, blocking of the valve. A doubled seal is therefore provided, formed by the inner sealing by the valve 12 and an outer sealing by means of the cap 31 generally shown in FIGS. 2 and 3. The cap 31 consists, accordingto the example of an embodiment shown, of sheet metal and is generally tubular. Its floor 30 is arranged such that the valve 12 of the inner seal lies below it. The cap has a rim 32 which is placed about the closure 11, i.e., about the crimped edge of the plate 10 and therefore about the edge 9 of the dome 8. An annular rubber seal 36 lies under the inner edge 35 of the rim 32 and effects the gastight closure of the inner space of the cap 31 from the exterior.

The rim 32 has an end edge 33 which lies under the plate edge and in this way locks the cap 31 axially. This edge 33 also bounds a flap 37 with an aperture 38. The flap 37 forms a handle generally referenced 34 and by means of which the cap can be separted. For this purpose, the rim 32 is torn and parted by means of the handle 34.

After the foam forming components have been charged, the propellant can be introduced via the opening 21 and the rubber valve ring 22 by means of the described hollow filling needle. The liquid propellant flows through the filling needle and thus reaches the [space] below the piston floor. After the required pressure has been reached in the propellant gas space 20, the filling needle is withdrawn, and the check valve then closes by itself, acted on by the propellant gas. The can is then ready for use.

Propellant can overflow between the piston skirt 15 and the cylinder wall 2 into the filling 23, in order to form there at least a part of the "yeast" for the foam. On the other hand, the liquid filling 23 cannot overflow into the propellant gas space 20, irrespective of the position of the can at any given time.

At the proper place, the handle 34 is actuated by the user in the manner described. The valve 12 hence becomes free. If the valve is opened by tilting the plate 43, the piston 14 travels upward. The piston position shown in FIG. 1 is that assumed when the can is about half emptied. As soon as the valve 12 is closed, the piston 14 remains in its existing position, to be set in motion again on further opening of the valve.

Ths piston finally reaches its end position, in which it abuts against the dome 8 or the closure flap 11. Propellant gas then penetrates between the piston skirt 15 and the cylinder wall 2 and pushes the liquid medium still enclosed in the greatly reduced or completely closed space 23 out through the valve 12, so that the can is completely emptied. The amount of propellant gas emerging through the valve 12 after the can is emptied is very small. Hence the whole amount of propellant gas needed for transport is retained in the can.

We claim:

1. A pressure can for dispensing polyurethane foams, comprising: a cylindrical body, a dome-like upper part having an opening therethrough; a closure member sealingly disposed across said opening; a valve body inset in said closure member for dispensing the contents of the can; a can bottom closing the end of said body opposite from said upper part; a piston slideably disposed in said cylinder intermediate its ends for dividing said cylinder into a foam-former filling space between said piston and closure member and a propellant space between said piston and said can bottom; said piston having a circumferential skirt depending therefrom toward said can bottom, and means for permitting a small amount of propellant to pass from said propellant space to said foam-former filling space while substantially preventing said foam-former from passing from said foam-former space to said propellant space, whereby said foam-former filling will have a small fraction of propellant dissolved therein while under pressure in the can, which fraction will flash from solution when said filling is dispensed from said can at atmospheric pressure, creating bubbles in said dispensed foam-former filling for enhancing its foaming.

2. The pressure can as recited in claim 1 wherein said propellant passing means comprises a gap between said skirt and the inside face of said body.

3. Pressure can according to claim 2, characterized in that the top of said piston has an indented middle and edge surfaces generally corresponding to the contour of the can dome and with which the piston abuts from inside, when at the upper end of said cylinder.

4. Pressure can according to one of claims 1 or 3, characterized in that the edge surfaces are curved inward and upward directly from said piston skirt toward the center of said cylinder.

5. Pressure can according to claim 4, characterized by a bead and annular groove in said piston skirt.

6. Pressure can according to claim 5 characterized in that said can bottom is a flanged-on bottom (6) on the lower edge (3) of the cylinder (2) and having a propellant filling opening (12) which can be closed by a check valve (22).

7. Pressure can according to claim 4 characterized in that said can bottom is a flanged-on bottom (6) on the lower edge (3) of the cylinder (2) and having a propellant filling opening (21) which can be closed by a check valve (22).

8. Pressure can according to one of claims 2 or 3 characterized in that said can bottom is a flanged-on bottom (6) on the lower edge (3) of the cylinder (2) and having a propellant filling opening (21) which can be closed by a check valve (22).

9. Pressure can according to claim 3 characterized in that the piston skirt has a bead and annular groove and the bottom has a propellant filling opening closed by a check valve.

10. Pressure can according to claim 9, characterized in that the check valve (22) is a plug of elastomeric material pressed into the bottom (6) and penetrable by a filling needle.

11. Pressure can according to claim 9, characterized in that said valve is enclosed within a cap which has a radially extending flange forming a gas-tight seal with said rim said flange axially locking the cap to said rim and being detachable by means of a handle fitted on the cap.

12. Pressure can according to claim 11, characterized in that the radially extending flange of the cap (31) seats tightly around the rim, said flange internally holding an annular seal (36) against the rim and the lower edge (33) of the flange seating under the rim and locking the cap (31) against axial displacement.

13. Pressure can according to claim 11, characterized in that said cap flange wraps under said rim, said handle depending from said locking edge such that said flange must be torn to remove the cap.

14. A pressure can for dispensing polyurethane foams, comprising: a cylindrical body having an internal chamber, a dome-like upper end member having an opening therethrough, a closure member mounted in and closing said opening and having an external radially projecting rim, a valve body inset in said closure member for dispensing the contents of the can; a bottom closing the end of said cylindrical body opposite said end member; a piston slideably disposed in said body intermediate its ends for dividing said chamber into a foam-former filling space between said piston and said closure member and a propellant space between said piston and said bottom; means for permitting a small amount of propellant to pass from said propellant space to said foam-former space while substantially preventing said foam-former from passing from said foam-former space to said propellant space; a cap covering said dispenser valve, said cap having a flange crimped around said rim of said closure member; and an annular seal of compressible material seated and clamped between said rim and flange preventing the diffusion of water vapor into the can during storage; a handle integral with and projecting radially from the edge of said flange for removing said cap.

* * * * *